US009861189B2

(12) United States Patent
Morgan et al.

(10) Patent No.: US 9,861,189 B2
(45) Date of Patent: Jan. 9, 2018

(54) PAINT BRUSH PACKAGING WITH EDGING CONFIGURATION AND METHODS OF USE

(71) Applicants: Brandon Morgan, Loma, CO (US); Grace Morgan, Loma, CO (US)

(72) Inventors: Brandon Morgan, Loma, CO (US); Grace Morgan, Loma, CO (US)

(73) Assignees: Brandon Morgan, Loma, CO (US); Grace Morgan, Loma, CO (US)

( * ) Notice: Subject to any disclaimer, the term of this patent is extended or adjusted under 35 U.S.C. 154(b) by 0 days.

(21) Appl. No.: 15/051,871

(22) Filed: Feb. 24, 2016

(65) Prior Publication Data

US 2017/0238695 A1 Aug. 24, 2017

(51) Int. Cl.

| | |
|---|---|
| ***B65D 83/10*** | (2006.01) |
| ***A46B 17/04*** | (2006.01) |
| ***B44D 3/12*** | (2006.01) |
| *B65D 75/14* | (2006.01) |

(52) U.S. Cl.

CPC ..... *A46B 17/04* (2013.01); *B44D 3/125* (2013.01); *B65D 75/14* (2013.01)

(58) Field of Classification Search

CPC ..... B44D 3/125; B44D 5/18; B44D 75/14; A46B 17/04; A46B 2200/202

USPC ..... 206/15.2, 15.3, 349, 361, 362.2, 362.4; 15/247, 248.1, 249.1

See application file for complete search history.

(56) References Cited

U.S. PATENT DOCUMENTS

| | | | | |
|---|---|---|---|---|
| 2,078,193 A | | 4/1937 | Campbell | |
| 2,175,587 A | | 10/1939 | Archer | |
| 2,290,359 A | * | 7/1942 | Ringler | B44D 3/123 206/15.3 |
| 2,791,790 A | | 5/1957 | Cooley | |
| 2,820,237 A | | 1/1958 | Maslaney | |
| 2,952,863 A | | 9/1960 | Klecki | |
| 2,979,189 A | * | 4/1961 | Risdon | B65D 75/02 206/15.3 |
| 3,930,278 A | | 1/1976 | Nasca | |
| 4,237,579 A | | 12/1980 | Salmon | |
| 5,191,973 A | * | 3/1993 | Shteynberg | B65D 75/02 206/15.2 |

(Continued)

FOREIGN PATENT DOCUMENTS

| | | |
|---|---|---|
| GB | 2012577 | 8/1979 |
| GB | 2225528 | 6/1990 |
| GB | 2485272 | 5/2012 |

OTHER PUBLICATIONS

International Search Report and Written Opinion for applications No. PCT/US17/18712 dated May 16, 2017.

*Primary Examiner* — Luan K Bui
(74) *Attorney, Agent, or Firm* — Workman Nydegger

(57) ABSTRACT

Reconfigurable paint brush containers provide both display packaging and an edging tool. The container has a painting edge aligned with bristles of the paint brush and a fulcrum on which the paint brush rests. The fulcrum initially spaces the bristles of the paint brush away from the painting edge in a resting state. The painting edge is aligned with a wall corner, where paint is to be applied and a force is applied to the paint brush in the direction of the fulcrum. The force overcomes the spacing effect and brings the bristles into contact with the painting edge such that paint on the bristles is applied in a straight line to a portion of the wall exposed to the bristles at the painting edge.

8 Claims, 11 Drawing Sheets

(56) References Cited

U.S. PATENT DOCUMENTS

| | | | | |
|---|---|---|---|---|
| 5,244,090 | A * | 9/1993 | Keith | A46B 17/04 206/361 |
| 5,363,959 | A | 11/1994 | Crosby | |
| 6,163,920 | A | 12/2000 | Meyer | |
| 6,199,694 | B1 * | 3/2001 | Van Diest | A46B 17/04 206/361 |
| 6,575,295 | B2 * | 6/2003 | Mayfield | A46B 17/04 206/15.3 |
| 6,932,217 | B1 * | 8/2005 | Bailey | A46B 17/04 206/362.4 |
| 8,074,796 | B1 * | 12/2011 | Andrews | A46B 17/04 206/15.3 |
| 8,091,701 | B1 * | 1/2012 | DePietro | B44D 3/123 206/15.3 |
| 8,939,286 | B2 | 1/2015 | Hesse | |
| 2006/0000730 | A1 | 1/2006 | Llano | |
| 2009/0078602 | A1 * | 3/2009 | White | A47L 13/51 206/361 |
| 2014/0061093 | A1 | 3/2014 | Hesse et al. | |
| 2015/0374113 | A1 | 12/2015 | Walker | |

* cited by examiner

PAINT BRUSH PACKAGING WITH EDGING CONFIGURATION AND METHODS OF USE

BACKGROUND

1. Technical Field

Embodiments of the present disclosure relate generally to reconfigurable paint brush packaging, and more specifically to multi-purpose paint brush packaging configurable into an edging tool, and methods of using the same.

2. Background and Relevant Art

Painting projects often require precise "cutting-in" of edges, corners, and other transitions of a painting surface. Thin, metal edging tools are available to provide a straight edge and paint shield at the transition. A painter can align the edge of the tool with the transition and apply paint to the painting surface on one side of the tool. When used properly, the tool is designed to reduce accidental painting of the painting surface on the other side of the tool.

A number of disadvantages exist in the field of paint edging tools. For instance, some painters may gain a false sense of security when using such edging tools—viewing the edging tool as a paint barrier, past which paint cannot pass. Accordingly, these painters may apply too much paint to the brush and/or run the paint-filled brush parallel along the tool edge. Such techniques often result in paint flowing over the tool edge and contacting the non-painting surface at the transition. Repetitive back-and-forth motion of the brush relative to and along the tool edge may accentuate this problem as additional layers of paint are applied to initial layers, thereby pushing paint further past the tool edge. Such spill-over paint must then be wiped off the non-painting surface or painted over after it dries, causing delay, additional effort, and/or added expense.

In addition, a painter typically must hold the edging tool in one hand and a paint brush in the other hand. In order for the painter to wipe off spill-over paint, move paint cans or trays, or perform other painting-related tasks, the painter must put down the brush or the edging tool, both of which can have a substantial amount of paint thereon. Similarly, the edging tool must be purchased separately from the paint brush, adding to the expense of the painting project.

Paint brushes are not generally provided with accessories, such as edging tools. Instead, brushes are sold individually or in multi-packs, often with display and/or storage packaging. Existing packaging includes brush or bristle wraps, trays, cartons, and enclosures. Some packaging is not designed for re-use and is discarded upon use. Other reusable packaging is configured to receive and protect the brush after an initial use. Certain packaging can even be configurable between a display state and a protective state. Regardless of specific configuration, however, there is not an existing paint brush packaging that provides an edging feature, and more especially that is selectively configurable between a packaging configuration and an edging configuration.

Accordingly, there are a number of limitations with existing paint brush products that can be addressed.

BRIEF SUMMARY

Embodiments of the present disclosure solve one or more of the foregoing or other problems and/or limitations in the art with single handheld paint brush/edging tools, and methods of using the same. Embodiments can include a packaging comprising (or formed of) paper or cardboard, plastic, or any suitable material. The packaging can be configured to receive a paint brush and can have a painting edge with which bristles of the paint brush can be aligned. The painting edge can also be aligned with a transition in a painting surface, where paint is to be applied. The packaging can also include a paint brush raising component that is positioned on the packaging and is structurally adapted to initially spaces at least the bristles of the paint brush away from the painting edge. A force applied to the paint brush in the direction of the paint brush raising component overcomes the spacing effect of the raising component and brings the bristles into contact with the painting edge such that paint applied to the bristles is applied in a straight line to a portion of the painting surface.

Additional features and advantages of the embodiments of the present disclosure will be set forth in the description which follows or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other advantages and features of the present disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1A:
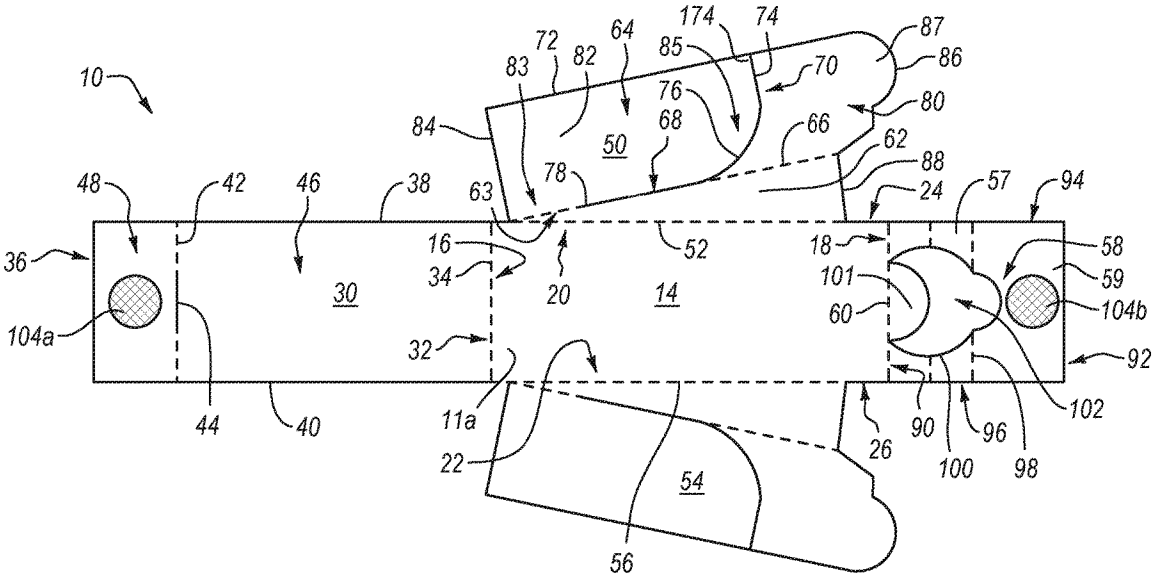
FIG. 1A illustrates a top plan view of a template useful in forming a reconfigurable paint brush container according to an embodiment of the present disclosure.

Previous paint brush packaging has been adapted to display and/or protect a paint brush product disposed therein. Embodiments of the present disclosure, however, can be used for cutting-in or otherwise applying paint at edges, corners, and other transitions of a painting surface. Embodiments of the present disclosure can be advantageous over existing systems, methods, and/or processes by providing multi-purpose, reconfigurable paint brush packaging that provides an edging tool. The packaging can comprise (or be formed of) paper or cardboard, plastic, or any suitable material. The packaging can be configured to receive a paint brush and can have a painting edge with which bristles of the paint brush can be aligned. The painting edge can also be aligned with a transition in a painting surface, where paint is to be applied. The packaging can also include a paint brush raising component that is positioned on the packaging and is structurally adapted to initially space at least the bristles of the paint brush away from the painting edge. A force applied to the paint brush in the direction of the paint brush raising component overcomes the spacing effect of the raising component and brings the bristles into contact with the painting edge such that paint applied to the bristles is applied in a straight line to a portion of the painting surface.

Before describing the present disclosure in further detail, it is to be understood that this disclosure is not limited to the description of the particularly exemplified systems, methods, and/or products that may vary from one embodiment to the next. Thus, while certain embodiments of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the embodiments, and is not necessarily intended to limit the scope of the claimed invention.

Unless defined otherwise, all technical and scientific terms used herein have the same meaning as commonly understood by one of ordinary skill in the art to which the present disclosure pertains.

As used herein, the term "paint brush" is used to describe a tool (or instrument) having a gripping component attached to a paint-receiving component. The gripping component provides for handheld use of the paint brush and can have any suitable configuration, such as a handle comprised of wood, plastic, fibers, or any suitable material. For convenience, all such gripping components are referred to herein as handles and are disposed at a handle end the paint brush.

The paint-receiving component can be used to transfer paint (i.e., receive paint and then apply the paint) to a surface and can have any suitable configuration, such as bristles, fibers, hairs, sponge or sponge-like material, or any suitable material. For convenience, all such paint-receiving components are referred to herein as bristles and are disposed at a brush end the paint brush.

As used herein, the term "paint" includes any surface coating, whether colored or clear, whether opaque or non-opaque, whether liquid, solid, or a combination thereof. Accordingly, paint includes primer, clear-coat, glaze, stain, oil, wax, powders, organics, synthetics, or any suitable material.

Various aspects of the present disclosure, including systems, processes, and/or products may be illustrated with reference to one or more embodiments or implementations, which are exemplary in nature. As used herein, the terms "embodiment" and "implementation" mean serving as an example, instance, or illustration, and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used herein, the term "systems" also contemplates devices, apparatus, compositions, assemblies, kits, and so forth. Similarly, the term "method" also contemplates processes, procedures, steps, and so forth. Moreover, the term "products" also contemplates devices, apparatus, compositions, assemblies, kits, and so forth.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "crease" includes one, two, or more creases. Similarly, reference to a plurality of referents should be interpreted as comprising a single referent and/or a plurality of referents unless the content and/or context clearly dictate otherwise. Thus, reference to "creases" does not necessarily require a plurality of such creases. Instead, it will be appreciated that independent of conjugation; one or more creases are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated.

To facilitate understanding, like references (i.e., like naming of components and/or elements) have been used, where possible, to designate like elements common to the figures. Specifically, in the exemplary embodiments illustrated in the figures, like structures, or structures with like functions, will be provided with similar reference designations, where possible. Specific language will be used herein to describe the exemplary embodiments. Nevertheless it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

It will also be appreciated that where multiple possibilities of values or a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or amount less than or equal to about 10 units or between 0 and 10 units includes, illustratively, a specific disclosure of: (i) a measurement or amount of 9 units, 5 units, 1 units, or any other value between 0 and 10 units, including 0 units and/or 10 units; and/or (ii) a measurement or amount between 9 units and 1 units, between 8 units and 2 units, between 6 units and 4 units, and/or any other range of values between 0 and 10 units.

The headings used herein are for organizational purposes only and are not meant to be used to limit the scope of the description or the claims.

Figure 1B:
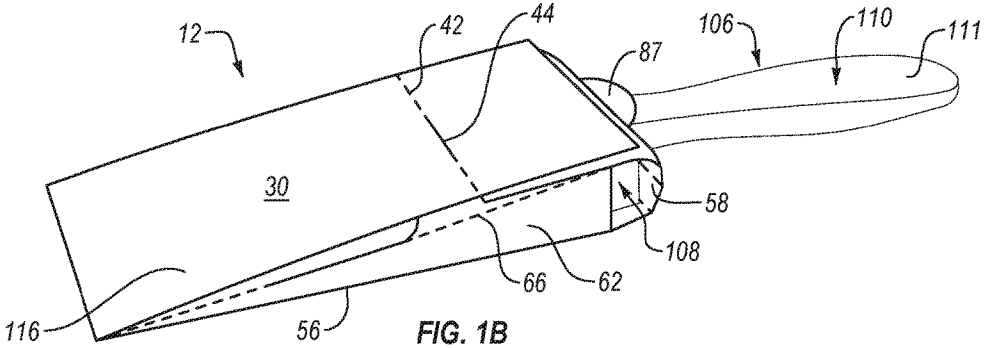
FIG. 1B illustrates a perspective view of a reconfigurable paint brush container formed from the template of FIG. 1A and disposed in a packaging configuration with a paint brush disposed therein.
Figure 1C:
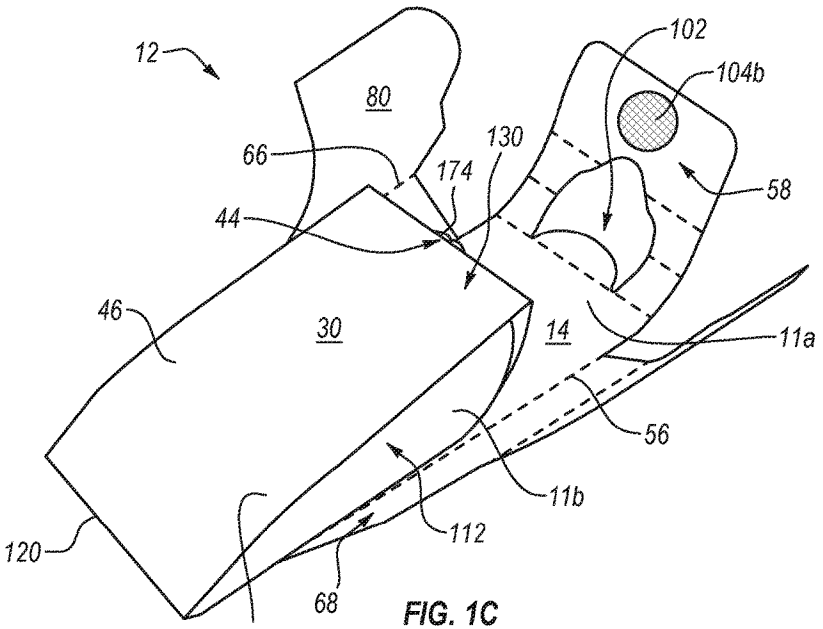
FIG. 1C illustrates a perspective view of the reconfigurable paint brush container of FIG. 1B in a partial edging configuration.
Figure 1D:
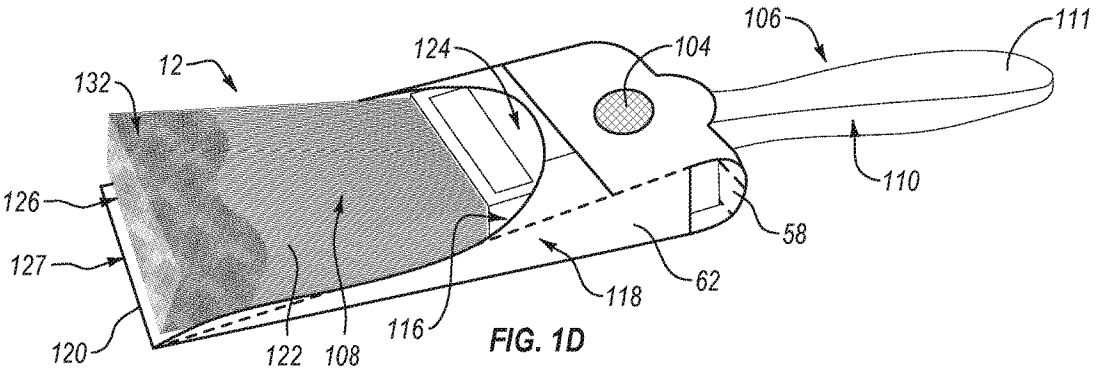
FIG. 1D illustrates a perspective view of the reconfigurable paint brush container of FIG. 1B in an edging configuration with a paint brush disposed therein.

Turning now to the figures, FIG. 1A illustrates a top plan view of a template 10 useful in forming a reconfigurable paint brush container 12, shown in FIGS. 1B-1D, according to an embodiment of the present disclosure. Template 10 can be comprised of a semi-rigid, foldable (sheet) material that retains a crease when folded. The material can comprise paper, such as card stock or card board, plastic, or any other suitable material. Template 10 and/or the components thereof can comprise an upper surface 11*a* and an opposing lower surface 11*b* (see FIGS. 1B and 1C) opposite upper surface 11*a*.

Template 10 comprises a base or floor panel 14 having a front edge 16, a rear edge 18 opposite front edge 16, a first side edge 20 extending between front edge 16 and rear edge 18 on a first side 24 of template 10 or floor panel 14 thereof, and a second side edge 22 extending between front edge 16 and rear edge 18 on a second side 26 of template 10 or floor panel 14 thereof, opposite first side 24.

Template 10 also comprises a cover panel 30 extending from front edge 16 of floor panel 14. Cover panel 30 has an inner edge 32 connected to front edge 16, with a first crease 34 formed between inner edge 32 and front edge 16, an outer edge 36 opposite inner edge 32, a first side edge 38 extending between inner edge 32 and outer edge 34 on first side 24 of template 10 or cover panel 30 thereof, and a second side edge 40 extending between inner edge 32 and outer edge 34 on second side 26 of template 10 or cover panel 30 thereof opposite first side 24. Cover panel 30 also includes a second crease 42 disposed between inner edge 32 and outer edge 36. First crease 34 and second crease 42 each extend laterally between the first side edge 38 and second side edge 40. Second crease 42 can divide cover panel 30 into a first portion 46 (proximal to inner edge 32) and a second portion 48 (proximal to outer edge 36). In one or more embodiments, cover panel 30 also includes a slit 44 extending along a portion of second crease 42.

Cover panel 30 is foldable along first crease 34 such that cover panel 30 overlays at least a portion of floor panel 14 (e.g., with upper surface 11*a* of cover panel 30 facing, touching, and/or adjacent to upper surface 11*a* of floor panel 14). For instance, when cover panel 30 is folded along the first crease 34, first side edge 38 of cover panel 30 can become substantially aligned with first side edge 20 of floor panel 14 and second side edge 40 of cover panel 30 can become (substantially) aligned with second side edge 22 of floor panel 14. As used herein, "align," "alignment," and similar terms refer to the positioning and/or disposition of two or more elements in adjacent spaces and does not necessarily imply or require that the two or more elements be immediately and/or exactly parallel, congruent, or equal in size. In some embodiments, for instance, first and/or second side edges 38 and 40 can be tapered relative to inner and outer side edges 20 and 22, respectively. In certain embodiments, cover panel 30 can be folded along first crease 34 such that outer edge 36 of cover panel 30 becomes (substantially) aligned with rear edge 18 of floor panel 14. Cover panel 30 is also foldable along second crease 42, such that upper surface 11*a* of second portion 48 faces, touches, and/or becomes disposed adjacent to upper surface 11*a* of the first portion 46.

Template 10 also includes a first side panel 50 extending from first side edge 20 of floor panel 14 with a third crease 52 disposed therebetween, a second side panel 54 extending from second side edge 22 of floor panel 14 with a fourth crease 56 extending therebetween, and a rear panel 58 extending from rear edge 18 of floor panel 14 with a fifth crease 60 extending therebetween. In at least one embodiment, first side panel 50 and second side panel 54 can be substantially similar in size, structure, and/or configuration. For instance, first side panel 50 and second side panel 54 can be mirror images of each other in at least one embodiment. In other embodiments, however, first side panel 50 and second side panel 54 can have different configurations.

As depicted in FIG. 1A, first side panel 50 has a sidewall portion 62 adjacent to third crease 52 and a cover portion 64 extending from sidewall portion 62, opposite third crease 52. A sixth crease 66 extends between at least a part of side wall portion 62 and cover portion 64. First side panel 50 also has a slit 68. In at least one embodiment, a first portion 70 of slit 68 can extend from an outer edge 72 of first side panel 50 or cover portion 64 thereof (opposite third crease 52) to or towards sixth crease 66. The first portion 70 of slit 68 can be linear (or has a linear segment) and/or curved (or have a curved segment). As depicted in FIG. 1A, first portion 70 begins with a linear segment 74 extending from outer edge 72 at upper corner 74 of lower portions 82 of side panels 50 and 54, and transitions into a curved segment 76 extending from linear segment 74 to or towards sixth crease 66. A second portion 78 of slit

68 can extend from sixth crease 66 (e.g., along a line defined by creases 66 such that second portion 78 of slit 68 comprises a continuation of sixth slit 66).

First portion 70 of slit 68 extends through a portion of first side panel 50 such that cover portion 64 thereof is divided into an upper portion 80 (adjacent to the rear panel 58) and a lower portion 82 (adjacent to cover panel 30). As illustrated in FIG. 1A, slit 68 (or second portion 78 thereof) does not extend entirely through first side panel 50 (or cover portion 64 thereof). In particular, slit 68 and/or second portion 78 thereof extends along the line defined by sixth slit 66, but does not extend to third crease 52 and/or a lower edge 84 of first side panel 50 (or lower portion 82 of cover portion 64). Lower edge 84 can extend from first side edge 20 of floor panel 14 or third crease 52. Accordingly, in at least some embodiments, a lower region 83 of cover portion 64 (or lower portion 82 thereof) can be continuous with a lower region 63 of sidewall portion 62 adjacent and/or along lower edge 84 and/or a part of first side panel 50 adjacent thereto. Lower region 83 of cover portion 64 (or lower portion 82 thereof) can be or comprise the portion of side panel 50, 54 adjacent lower edge 84 and/or beyond slit 68 (or second portion 78 thereof). An opposing upper region 85 thereof can be disposed adjacent to slit 68.

Upper portion 80 of first side panel 50 and/or cover portion 64 thereof has an upper edge 86 extending from and/or continuous with an upper edge 88 of sidewall portion 62, and a tab 87 adjacent to upper edge 86. Tab 87 can have a rounded configuration, as depicted in the illustrated embodiment. Upper edge 88 of sidewall portion 62 can similarly extend from first side edge 20 of floor panel 14 or third crease 52 (adjacent to rear panel 58). Second side panel 54 can be configured substantially similar to the first side panel 50.

Rear panel 58 also has an inner edge 90 extending from rear edge 18 of floor panel 14 (with fifth crease 60 disposed therebetween), an outer edge 92 opposite inner edge 90, a first side edge 94 extending between the inner edge 90 and outer edge 92 on first side 24 of template 10 and/or from first side edge 20 of floor panel 14, and a second side edge 96 extending between the inner edge 90 and outer edge 92 on second side 26 of template 10 and/or from second side edge 22 of floor panel 14, opposite first side edge 94. Rear panel 58 also includes a seventh crease 98 disposed between inner edge 90 and outer edge 92 and extending between the first side edge 94 and second side edge 96. Seventh crease 98 divides rear panel 58 into a sidewall portion 57 (adjacent inner edge 90) and a cover portion 59 (adjacent outer edge 92). Rear panel 58 can also include an optional eighth crease 100, disposed (equal-distant) between the fifth crease 60 and eighth crease 100, and a tab opening 102 extending through rear panel 58 (from upper surface 11*a* (through) to lower surface 11*b*). As depicted in FIG. 1A, opening 102 has a crescent shaped lower portion, leaving a rounded tab 101. In at least one embodiment, Opening 102 can be sized and/or configured to receive one or more tabs 87 therein.

As depicted in FIG. 1A, template 10 can also include a first fastening element (or fastener) 104*a* (disposed on upper surface 11*a* of cover panel 30 and/or second portion 48 thereof) and a second fastener 104*b* (disposed on upper surface 11*a* of rear panel 58). In some embodiments, will template 10 can also include one or more additional fasteners 104. For instance, template 10 can also include a fastener 104 disposed on lower surface 11*b* of rear panel 58 (opposite the fastener 104*b*). Upper portion 80 of cover portion 64 can also include a fastener 104 disposed on a lower surface of 11*b* of respective side panels 50 and/or 54. As described in further detail below, fasteners 104 can be configured to (reversibly) secure and/or maintain template 10 in one or more folded configurations.

As used herein, the "fastener," "fastening element," and similar terms include hook and loop (or hook-and-loop) elements (a.k.a. Velcro), adhesive materials, such as glue, tape (single- or double-sided), spray, putty, as the like, clasping elements, locking elements, and any other suitable means for attaching two or more components. In some embodiments, such fasteners can be reversibly attachable and re-attachable. In other embodiments, the fasteners can be substantially, permanently attachable, such that the fastener is not configured to be reversibly attachable and re-attachable.

Figure 2A:
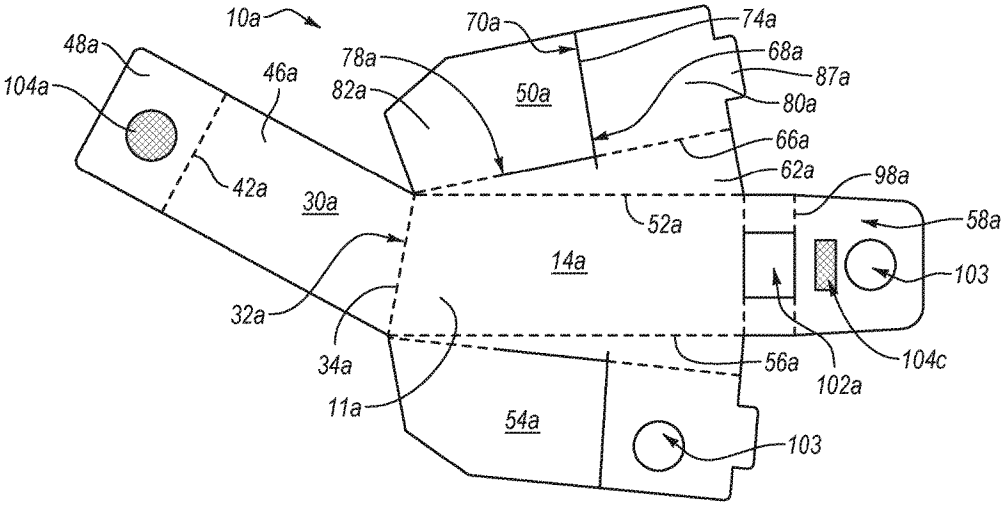
FIG. 2A illustrates a top plan view of a template useful in forming a reconfigurable paint brush container according to another embodiment of the present disclosure.
Figure 2B:
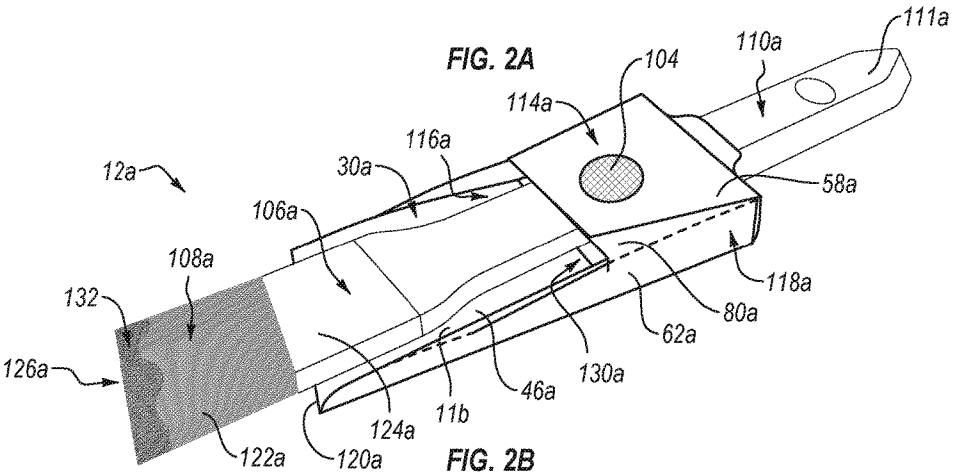
FIG. 2B illustrates a perspective view of a reconfigurable paint brush container formed from the template of FIG. 2A and disposed in an edging configuration with a paint brush disposed therein in an advanced position.

As depicted in FIG. 2B, for instance, template 10 can be folded into a reconfigurable paint brush container 12 in the packaging configuration. Container 12 can be sized and/or configured to receive at least a portion of a paint brush 106 having a specific size and/or configuration. As discussed in further detail below, for instance, container 12 can be sized and/or configured to receive a brush end 108 of the paint brush 106, while a handle end 110 of paint brush 106 extends from container 12. As depicted in FIGS. 1A and 1D, handle end 110 can comprise a handle 111 and brush end 108 can comprise bristles 122. Brush end 108 can also comprise a middle portion 124 disposed between (and attached to) handle 111 and/or bristles 122. Bristles 122 can also have a leading edge 126.

With continuing reference to FIGS. 1A and 1B, in the packaging configuration (or to form container 12 in the packaging configuration), with a paint brush 106 disposed therein, as depicted in FIG. 2B, template 10 is folded along creases 52, 56, and 60 such that side panels 50 and 54 (or respective sidewall portions 62 thereof) and rear panel 58 (or sidewall portion 57 thereof) are folded upward, substantially perpendicular to floor panel 14. Paint brush 106 is disposed with brush end 108 (e.g., bristles 122 and/or middle portion 124) on upper surface 11*a* of floor panel 14 and handle 111 extending through the opening 102 of rear panel 58. Template 10 is also folded along respective creases 66 of side panels 50 and 54, such that respective cover portions 64 thereof fold over brush end 108 of paint brush 106. At least a portion of respective cover portions 64 can overlay one another, such that respective cover portion 64 are disposed in a stacked configuration (e.g., with upper surface 11*a* a first cover portion 64 facing brush end 108 and upper surface 11*a* of a second cover portion 64 facing lower surface 11*b* of first cover portion 64).

Template 10 and/or rear panel 58 thereof can also be folded along crease 98, and optionally along crease 100, such that cover portion 59 of rear panel 58 folds over brush end 108 of paint brush 106. In at least one embodiment, cover portion 59 of rear panel 58 can be folded over the top of cover portions 64 of side panels 50 and 54. In one or more embodiments, template 10 can provide means for maintaining one or more components of template 10 in one or more folded configurations. For instance, in some embodiments, the means for maintaining can include tabs 87 of upper portion 80 of cover portions 64 and opening 102 of rear panel 58. Tabs 87 can be inserted through opening 102, such that the side edges of opening 102 can retain tabs 87 and restricted and/or prevented side panels 50 and 54 from unfolding.

In at least one embodiment, the means for maintaining can comprise fastener 104*b*. For instance, fastener 104*b* can be (directly or indirectly) reversibly attached to lower surface 11*b* of folded cover portion 64 or upper portion 80 thereof. In one or more embodiments, lower surface 11*b* of cover portion 64 or upper portion 80 thereof (of one or more side panels 50, 54) can have a corresponding fastener 104 disposed thereon, such that fastener 104*b* mates with the corresponding fastener 104 and becomes (reversibly) attached thereto. In at least one embodiment, the corresponding fastener 104 and fastener 104*b* can comprise corresponding parts of the hook and loop fastener.

Template 10 can also be folded along crease 34, such that cover panel 30 folds over brush end 108 of paint brush 106. As depicted in FIG. 2B, for instance, cover panel 30 can be folded over folded side panels 50 and 54 and folded rear panel 58, such that upper surface 11*a* of cover panel 30 faces lower surface 11*b* of folded side panels 50 and 54 and folded rear panel 58. In some embodiments, means for maintaining are also provided for cover panel 30. For instance, fastener 104*a* can be (directly or indirectly) reversibly attached to lower surface 11*b* of folded rear panel 58. In at least one embodiment, the lower surface 11*b* of rear panel 58 can have a corresponding fastener 104 disposed thereon, such that fastener 104*a* mates with the corresponding fastener 104 and becomes (reversibly) attached thereto. In at least one embodiment, the corresponding fastener 104 and fastener 104*a* can comprise corresponding parts of the hook and loop fastener.

Alternatively, template 10 can be folded into an edging configuration as shown in FIGS. 1C-1D and described herein. As described previously, template 10 can be folded along creases 52 and 56 to erect sidewall portions 62 relative to floor panel 14. In addition, by means of slit 68, lower portion 82 of the side panels 50 and 54 can be folded along crease 66, while upper portion 80 of side panels 50 and 54 remains substantially unfolded along crease 66. Thus, lower portion 82 can be folded over floor panel 14. Template 10 can also be folded along crease 34, such that cover panel 30 (or first portion 46 thereof) folds over folded lower portions 82, with upper surface of 11*a* of cover panel 30 (or first portion 46 thereof) facing lower surface 11*b* of lower portion 82. The folding of template 10 along crease 34 can also form a painting edge 120 (along crease 34 at outer surface 11*b* of template 10). In at least one embodiment, floor panel 14 and/or cover panel 30 terminates at painting edge 120. Painting edge 120 can be (substantially) linear in one or more embodiments.

Cover panel 30 can also be folded along crease 42, such that a second portion 48 of cover panel 30 folds under lower portions 82, with upper surface of 11*a* of cover panel 30 (or first portion 46 thereof) facing upper surface 11*a* of lower portion 82. Accordingly, the cover panel 30 can be folded about lower portions 82 of side panels 50 and 54. In some embodiments, corners 174 of lower portions 82 of side panels 50 and 54 (or upper region 85 thereof) can be inserted into slit 44, thereby securing lower portions 82 to cover panel 30. In this folded (and optionally secured) configuration (as illustrated in FIGS. 1C and/or 1D), folded cover panel 30 and folded lower portions 82 of side panels 50 and 54 form a raising component 112. As used herein, "form," "forming," and similar terms are inclusive and/or open-ended, such that one or more components forming an element does not negate the element comprising additional components. Accordingly, raising component 112 comprises (at least) folded cover panel 30 and folded lower portions 82 of side panels 50 and 54, in the illustrated embodiment. It is noted, however, that in other embodiments, raising component 112 can comprise (at least) folded cover panel 30 or folded lower portions 82 of side panel 50 or 54.

In certain embodiments, raising component 112 can be attached to and/or extend from (upper surface 11*a* of) floor panel 14. Indeed, in the embodiment illustrated in FIGS. 1C-1D, raising component 112 can be attached to and/or extend from of floor panel 14. For instance, as described above, cover panel 30 extends from a front edge 16 of floor panel 14. Thus, raising component 112 is attached to and extends from floor panel 14. Moreover, with cover panel 30 folded such that a second portion 48 thereof folds beneath lower portions 82 of side panels 50 and 54, second portion 48 can contact upper surface 11*a* of floor panel 14.

In addition, because second portion 48 is folded under first portion 46 and/or because lower portions 82 of side panels 50 and 54 are disposed between the first portion 46 and second portion 48 of cover panel 30, raising component 112 may not be disposed or lay (flat) against upper surface 11*a* of floor panel 14, in a folded, resting position (as illustrated in FIGS. 2C and/or 2D). For instance, folded second portion 48 can space raising component 112 and/or cover panel 30 thereof away from upper surface 11*a* of floor panel 14 (as second portion 48 tends to at least partially rebound into the unfolded configuration illustrated in FIGS. 1A-1B. In addition, fastener 104*a* can be disposed between the first portion 46 and second portion 48 of cover panel 30 in the folded configuration, such that second portion 48 may not lay (flat) against first portion 46.

Furthermore, because crease 66 can extend (substantially or entirely) to crease 52 and/or because slit 68 or second portion 78 thereof may not extend (entirely) to crease 52, lower portions 82 of side panels 50 and 54 may not collapse and/or fold against (or may not be collapsible and/or foldable against) upper surface 11*a* of floor panel 14, in the resting position. Thus, in the folded, resting position, raising component 112 and/or one or more components thereof can be spaced away from upper surface 11*a* of floor panel 14.

In one or more embodiments, upper portions 80 of side panels 50 and 54, respectively, and/or rear panel 58 can be folded into a paint brush retaining element 114. For instance, as indicated above, template 10 can be folded along crease 66, such that upper portions 80 of side panels 50 and 54, respectively, fold over floor panel 14, and along crease 98 (and optionally crease 100), such that cover portion 59 of rear panel 58 folds over floor panel 14. Upper portions 80 of side panels 50 and 54 and cover portion 59 of rear panel 58 can be folded in any suitable order or sequence, as described above. However, in at least one embodiment, a fastener 104*b* can be secured (directly or indirectly) to lower surface 11*b* of upper portion 80. For instance, a corresponding fastener 104 can be attached to lower surface 11*b* of upper portion 80 of side panel 50 or 54.

As depicted in FIG. 1D, container 12 can comprise (or form) a paint brush receiving element (or area) 116. For instance, at least a portion of upper surface 11*a* of floor panel 14 can form a bottom portion of receiving area 112, one or more of opposing sidewall portion 62 of side panel 50, 54 and/or sidewall portion 57 of rear panel 58 can form a sidewall 118 of receiving area 112, and/or retaining element 114 can form a top portion of receiving area 112. Stated another way, receiving element 116 can comprise at least a portion of floor panel 14, a sidewall 118 (comprising opposing sidewall portions 62 of side panels 50 and 54 and/or sidewall portion 57 of rear panel 58), and/or retaining element 114, or respective upper surfaces 11*a* thereof. Moreover, at least a portion of floor panel 14, sidewall 118 (comprising opposing sidewall portions 62 of side panels 50 and 54 and/or sidewall portion 57 of rear panel 58), and/or retaining element 114, or respective upper surfaces 11*a* thereof, can at least partially bound receiving element 116. Accordingly, the receiving element 116 can include an upper surface portion of floor panel 14, sidewall 118 (comprising opposing sidewall portions 62 of side panels 50 and 54 and/or sidewall portion 57 of rear panel 58), and/or retaining element 114. Thus, paint brush 106 (or brush end 108 thereof) can be disposed in the upper surface portion of floor panel 14, sidewall 118 (comprising opposing sidewall portions 62 of side panels 50 and 54 and/or sidewall portion 57 of rear panel 58), and/or retaining element 114.

As further depicted in FIG. 1D, a portion of paint brush 106 (e.g., brush end 108 or bristles 122 and/or middle portion 124 thereof) can be disposed on top of raising component 112, beneath retaining element 114, and/or within side wall 118, or between components thereof. In certain embodiments, raising component 112 can space bristles 122 (or leading edge 126 thereof) away from painting edge 120. For instance, while cover panel 30 extends from painting edge 120, second portion 48 and/or lower portions 82 of side panels 50, 54 can lift (or space) first portion 46 of cover panel 30 away from floor panel 14. Moreover, raising component 112 can provide or form a fulcrum 130, on which paint brush 106 can rest. Fulcrum 130 can comprise an edge formed at folded crease 42 and/or a part of first portion 46 adjacent crease 42, in some embodiments.

Raising component 112 (or fulcrum 130 thereof) can also be structurally configured (or adapted) to space bristles 122 (or leading edge 126 thereof) away from painting edge 120 by forming a ramp. For instance, as indicated above, slit 68 may not extend entirely to crease 52. Accordingly, lower part 83 of side wall panel 50, 54 (or lower portion 82 thereof) can be raised above upper surface 11*a* of floor panel 14 by means of sidewall portion 62 (or lower part 63 thereof). Upper region 85, on the other hand, can become depressed under the weight of brush 106, such that lower part 63 raises (or spaces) bristles 122 (or leading edge 126 thereof) relative to handle end 110 (or handle 111 thereof) and/or away from painting edge 120. In at least one embodiment, middle portion 124 and/or a portion of handle 111 can rest on upper surface 11*a* of floor 14 adjacent rear panel 58. Retaining element 114 can be structurally adapted and/or positioned to retain paint brush 106 in the receiving element 116 and/or atop raising component 112. For instance, retaining element 114 can apply a force (or pressure) to a portion of paint brush 106 (e.g., middle portion 124 and/or handle 111) such that the portion of paint brush 106 is pressed against upper surface 11*a* of floor 14.

As illustrated in FIG. 1D, raising component 112 can space bristles 122 and/or leading edge 126 thereof away from painting edge 120 (e.g., such that a (vertical) gap or spacing 127 is disposed therebetween. Leading edge 126 of bristles 122 can also be (substantially) aligned with painting edge 120 of container 12, even with gap or spacing 127 disposed therebetween. Accordingly, with paint 132 disposed on bristles 122 (or leading edge 126 thereof), painting edge 120 can provide a straight edge for painting (or edging) a transition in a painting surface, as discussed in further detail below. In some embodiments, for instance, the spacing effect of raising component 112 can be overcome by applying additional (downward) pressure on paint brush 106 (e.g., toward upper surface 11*a* of floor 14). For instance, a downward force applied to bristles 122 (or leading edge 126 thereof), in the direction of raising component 112, can bring leading edge 126 adjacent to and/or in contact with painting edge 120. The force can be applied to bristles 122 (or leading edge 126 thereof) directly, in some embodiments, by pressing downward on bristles 122, middle portion 124, retaining element 114, etc.

In certain embodiments, pressure can be applied to bristles 122 (or leading edge 126 thereof) indirectly by means of fulcrum 130. For instance, handle 111 can be lifted upwards while applying a stabilizing (downward) force to a portion of paint brush 106 (e.g., atop fulcrum 130). In at least one embodiment, for example, a downward force can be applied to retaining element 114, middle portion 124, bristles 122, and/or brush end 108 of paint brush 106, while an upward force (opposite the downward force) is applied to handle 111.

Figure 5A:
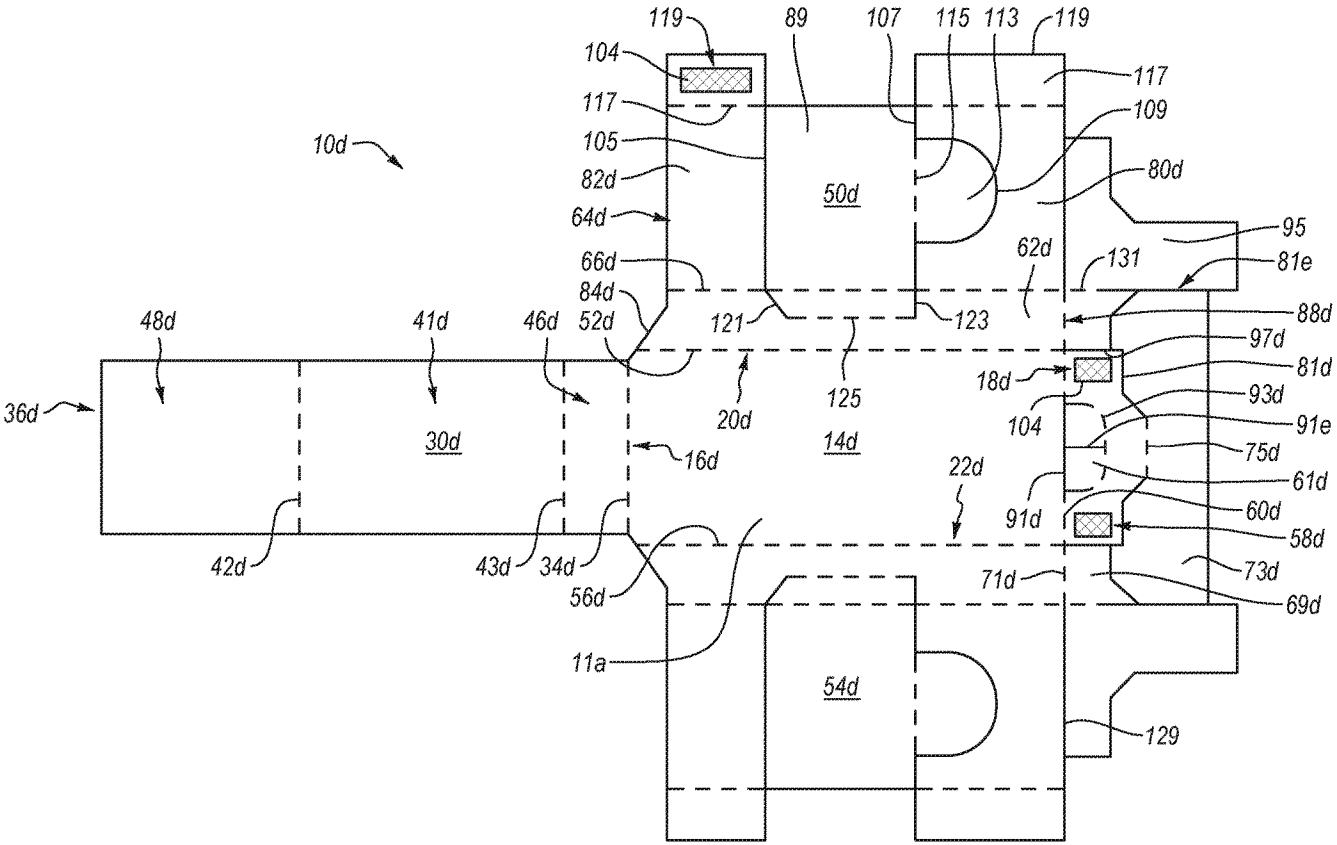
FIG. 5A illustrates a top plan view of a template useful in forming a reconfigurable paint brush container according to another embodiment of the present disclosure.
Figure 5B:
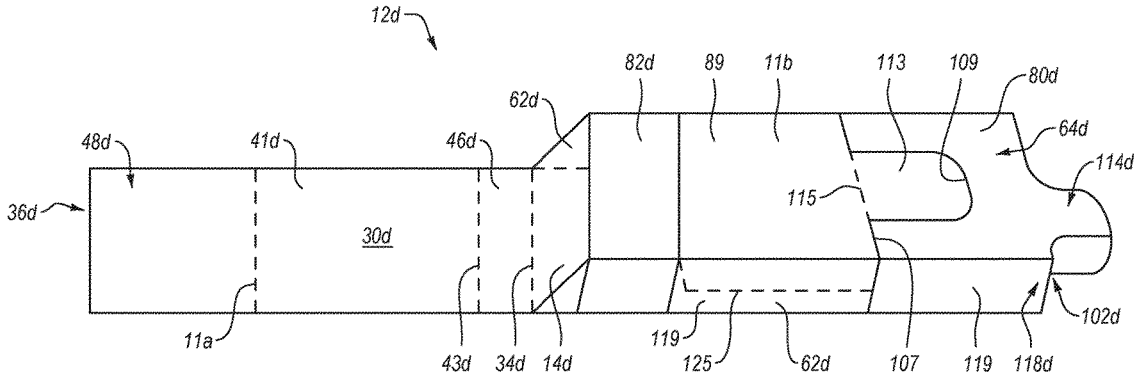
FIG. 5B illustrates a perspective view of a reconfigurable paint brush container formed from the template of FIG. 5A and disposed in an opened packaging configuration.
Figure 5C:
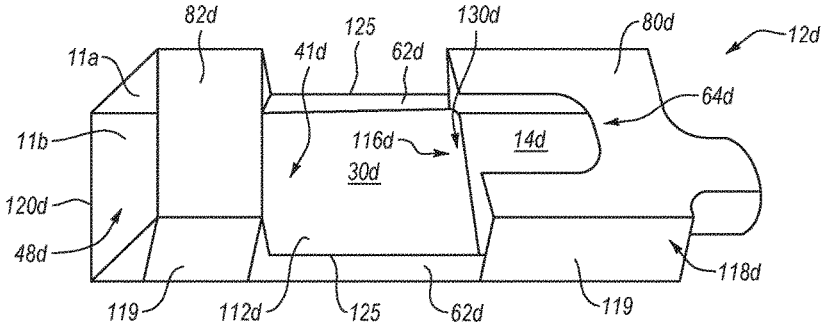
FIG. 5C illustrates a perspective view of the reconfigurable paint brush container of FIG. 5B disposed in an edging configuration.
Figure 5D:
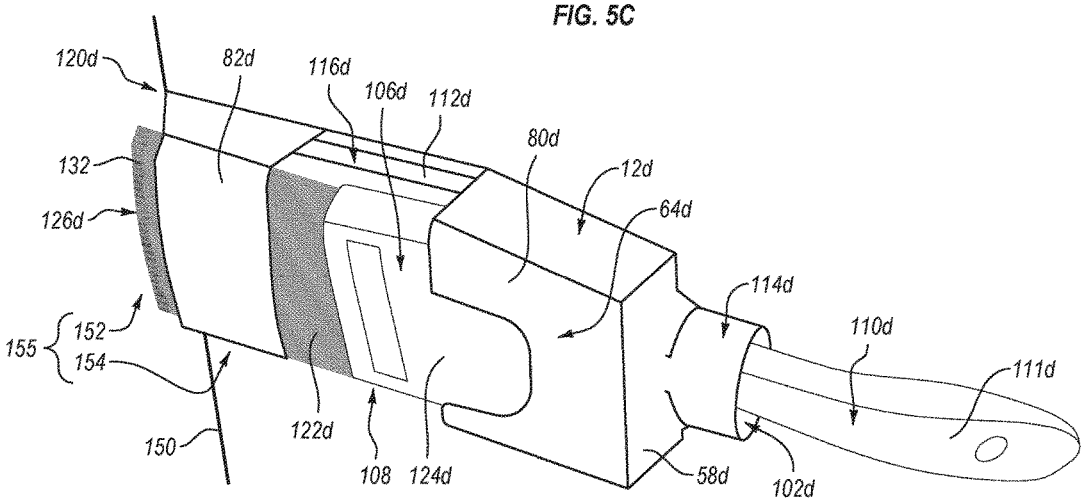
FIG. 5D illustrates a perspective view of the reconfigurable paint brush container of FIG. 5C in a painting environment and with a paint brush disposed therein.

Accordingly, a method of painting a transition in a painting surface (e.g., cutting-in a wall corner) with paint can include positioning paint brush 106 within receiving element 116 of paint brush container 12, container 12, applying paint 132 to bristles 122 of paint brush 106, aligning leading edge 126 of bristles 122 with painting edge 120 of container 12, aligning painting edge 120 of container 12 with a transition in a painting surface (see, for example, transition (e.g., corner) 150 of painting surface 152 of FIG. 5D), and applying a force on paint brush 106 in the direction of raising component 112, the force overcoming the spacing of raising component 112 and bringing bristles 122 (or leading edge 126 thereof) into proximity or contact with painting edge 120, such that paint 132 is applied to a portion of the painting surface. The method can also include forming raising component 112 by folding template 10 along crease 34. Additional folding steps, as described herein, can also be performed.

It is noted that structural components, including, but not limited to surfaces, sides, ends, edges, portions, parts, panels, creases, slits, tabs, openings, fasteners, materials, and so forth, as well as method steps, including, but not limited to folding, forming, erecting, aligning, applying, inserting, disposing, placing, and so forth, disclose and/or described in relation to the embodiment depicted in FIGS. 1A-1D, can be incorporated in other embodiments of the present disclosure without specific recitation thereof. Similarly, structural components and/or method steps disclose and/or described in relation to other embodiments can be incorporated into the embodiment depicted in FIGS. 1A-1D and/or additional embodiments of the present disclosure without specific recitation thereof. Accordingly, the description of a specific embodiment need not recite (or label in the figures) each and every component (or indicate each and every function) thereof. Instead, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

FIG. 2A illustrates an alternative embodiment of a template 10*a*, useful in forming container 12*a* (depicted in FIG. 2B). Template 10*a* includes many of the same or similar components, or components having the same or similar function, as found in template 10. For instance, template 10*a* has a floor panel 14*a* with a front edge 16*a* and a cover panel 30*a* with an inner edge 32*a* extending from floor panel 14*a*, with a crease 34*a* disposed therebetween. Unlike template 10, however, crease 34*a* is disposed at an angle relative to floor panel 14*a* and/or cover panel 30*a*. Accordingly, template 10*a* is foldable and/or configurable into a paint brush packaging container adapted for a paint brush 106*a* having a tapered leading edge 126*a* (see FIG. 2B).

Moreover, unlike template 10, template 10*a* comprises a slit 68*a* extending through a portion outside panels 50*a* and 54*a*, slit 68*a* having a first portion 70*a* comprising a linear segment 74*a* that extends at least partially into side wall panel 62*a*. In some embodiments, first portion 70*a* does not include a curved segment. Similar to template 10, second portion 78*a* of slit 68*a* travels along a portion of the line defined by creases 66*a*.

Paint brush 106*a* can be placed on upper surface 11*a* of floor panel 14*a* with handle 111*a* thereof extending through opening 102*a* and leading edge 126*a* thereof aligned with crease 34*a*. Template 10*a* can then be folded about paint brush 106*a* as described previously in relation to template 10. For instance, template 10*a* can be folded along creases 52*a* and 56*a* so as to erect sidewall panels 62*a*. Each side can then be folded along crease 66*a* to cover paint brush 106*a*. In at least one embodiment, side panel 50*a* can be folded first, followed by side panel 54*a*, after which, rear panel 58*a* can be folded along creases 60*a* and 98*a*, such that tabs 87*a* extends through opening 102*a*.

Upper portion 80*a* can have a first fastener 104 disposed on lower surface 11*b* thereof. The fastener 104*c* disposed on upper surface 11*a* of rear panel 58*a* can be sized and/or configured to mate with first fastener 104 of upper portion 80*a*. As described above, upper portion 80*a* can also have a second fastener 104 disposed on lower surface 11*b* thereof and configured to mate with fastener 104*a* of cover panel 30*a*. Openings 103 can be sized and configured to expose second fastener 104 therethrough, such that when cover panel 30*a* is folded along crease 34*a* so as to cover brush and 108*a* of paint brush 106*a*, fastener 104*a* on upper surface 11*a* of cover panel 30*a* mates with the second fastener 104 on upper portion 80*a*, to secure container 12*a* in a packaging configuration (not shown). Alternatively, upper portion 80*a* can have a single fastener 104 disposed thereon, and fasteners 104*a* and 104*c* can each mate with the single fastener 104.

FIG. 2B, on the other hand, illustrates an edging configuration of container 12*a*. In the edging configuration, template 10*a* is folded along creases 52*a* and 56*a* so as to erect sidewall panels 62*a*. However, unlike the packaging configuration, template 10*a* is folded along second portion 78*a* of slit 68*a*, such that lower portion 82*a* of side panels 50*a* and 54*a* are folded over floor panel 14*a*. Cover panel 30*a* is folded along crease 34*a* such that first portion 46*a* covers lower portions 82*a*. Cover panel 30*a* is also folded along crease 42*a* such that second portion 48*a* folds under lower portions 82*a*, adjacent to and optionally extending from upper surface 11*a* of floor panel 14*a*, thereby forming raising component 112*a*.

The connection between cover panel 30*a* and floor panel 14*a* at leading edge 120*a*, as well as the presence of lower portions 82*a* and second portion 48*a* beneath first portion 46*a* of cover panel 30*a* provides a hinged, spring-board, and/or spacing element to raising component 112*a*. Upper portions 80*a* are folded along creases 66*a* so as to fold over floor panel 14*a*, and rear panel 58*a* is folded along creases 60*a* and 98*a* so as to fold over folded upper portions 80*a*, forming sidewall 118*a*, retaining element 114*a*, and forming receiving area 116*a*. As described above, fastener 104*c* can mate with a corresponding fastener 104 disposed on lower surface 11*b* of upper portion 80*a*, thereby securing sidewall 118*a* and retaining element 114*a* in a folded configuration, as in the depicted embodiment. Raising component 112*a* can be depressed towards upper surface 11*a* of floor panel 14*a*, overcoming the spacing effect thereof away from upper surface 11*a* of floor panel 14*a*. Handle 111*a* of paint brush 106*a* can be inserted through receiving area 116*a*, between depressed raising component 112*a* and a retaining element 114*a*, and through opening 102*a*, as depicted in FIG. 2B. Paint 132 can be applied to bristles 122*a* and/or leading edge 126*a* thereof, and paint brush 106*a* can be retracted into receiving area 116*a* such that leading edge 126*a* becomes aligned with painting edge 120*a* of container 12*a*.

In some embodiments, paint 132 can be applied to a painting surface (e.g., at a transition, such as a corner). Paint brush 106*a* can then be advanced forward such that leading edge 126*a* extends beyond the painting edge 120*a*. Additional paint 132 can then be applied to bristles 122*a* or leading edge 126*a* thereof and a paint brush 106*a* can again be retracted into receiving area 116*a* such that leading edge 126*a* becomes aligned with painting edge 120*a* of container 12*a* for further painting. As described above, raising component 112*a* can space bristles 122*a* and/or leading edge 126*a* thereof away from painting edge 120*a* (e.g., such that a (vertical) gap or spacing is disposed therebetween. The spacing effect of raising component 112*a* can be overcome by applying force (or pressure) to paint brush 106*a*, as described above.

Figure 3A:
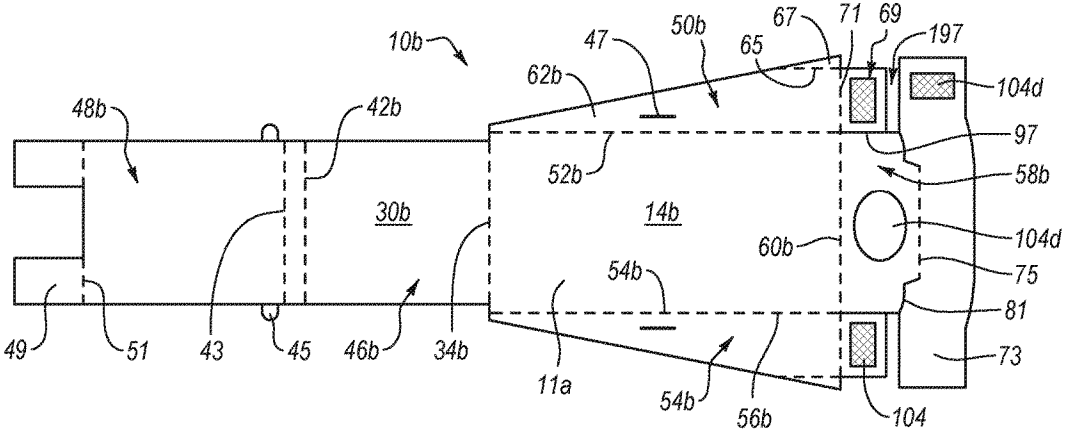
FIG. 3A illustrates a top plan view of a template useful in forming a reconfigurable paint brush container according to another embodiment of the present disclosure.
Figure 3B:
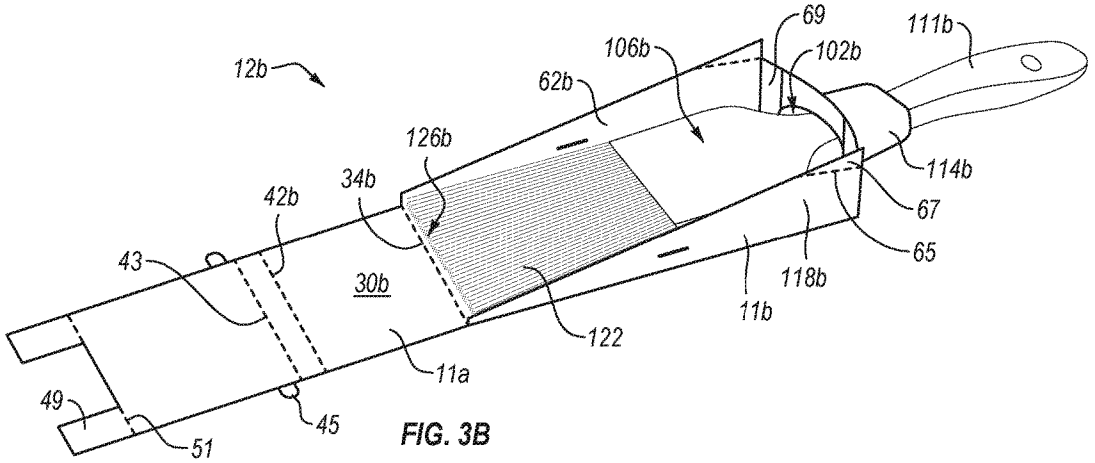
FIG. 3B illustrates a perspective view of a reconfigurable paint brush container formed from the template of FIG. 3A and disposed in an opened packaging configuration with a paint brush disposed therein.
Figure 3C:
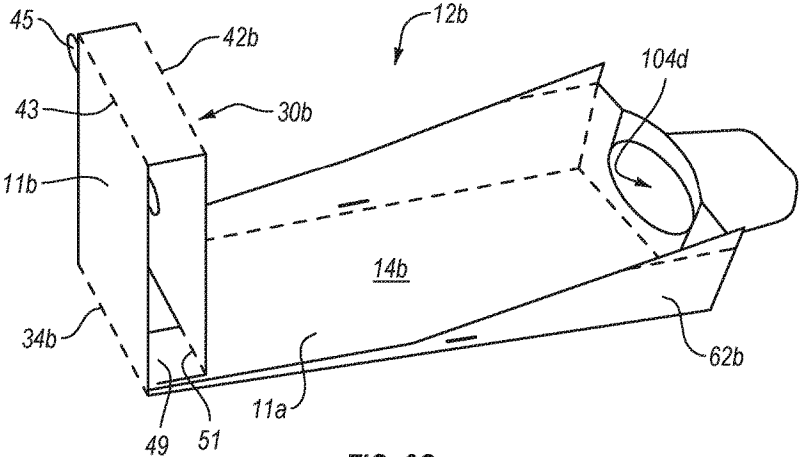
FIG. 3C illustrates a perspective view of the reconfigurable paint brush container of FIG. 3B in a partial edging configuration.
Figure 3D:
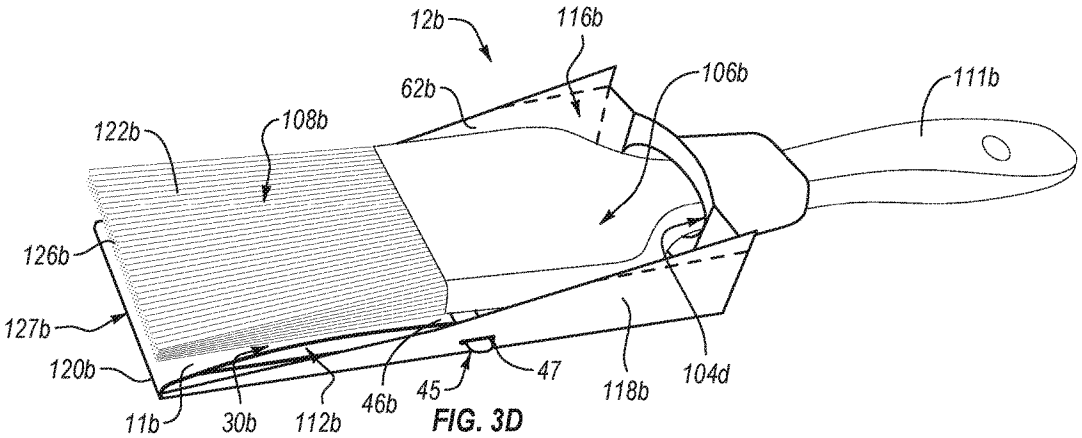
FIG. 3D illustrates a perspective view of the reconfigurable paint brush container of FIG. 3B in an edging configuration with a paint brush disposed therein.

FIG. 3A illustrates another embodiment of a template 10*b* useful in forming paint brush packaging container 12*b* illustrated in FIGS. 3B-3D. Template 10*b* has a floor panel 14*b* and a cover panel 30*b* extending therefrom, with a crease 34*b* disposed therebetween, and side panels 50*b* and 54*b* extending therefrom, with creases 52*b* and 54*b* disposed therebetween, as described above. Unlike templates 10 and 10*a*, however, side panels 50*b* and 54*b* do not include cover portions, as described above. Instead, sidewall portions 62*b* has a crease 65 that allows a corner portion 67 of sidewall portion 62*b* to be folded over floor panel 14*b*. In addition, side panels 50*b* and 54*b* each have a rear tab 69 extending from side panel 50*b* (or sidewall portion 62*b* thereof) adjacent to rear panel 58*b*, with a crease 71 disposed between rear tab 69 and side panel 50*b* (or sidewall portion 62*b* thereof, and a slit 97 disposed between rear tab 69 and rear panel 58*b*. In at least one embodiment, a crease 71 can be aligned with crease 60*b*. In some embodiments, a gap 197*b* can be formed between rear tab 69 and rear panel tab 73.

As depicted in FIG. 3B, template 10*b* can be folded along creases 52*b* and 56*b* to erect sidewall panels 62*b*, and along creases 71, thereby aligning tabs 69 with crease 60*b*. Template 10*b* can also be folded along crease 60*b* to erect rear panel 58*b*, such that upper surface 11*a* of rear panel 58*b* faces lower surface 11*b* of opposing tabs 69, or vice versa, thereby forming sidewall 118*b*. One or more of opposing tabs 69 and/or rear panel 58*b* can have a fastener 104 disposed thereon. For instance, opposing tabs 69 can each have a fastener 104 disposed on lower surface 11*b* thereof. For the sake of convenience, however, fasteners 104 are depicted on upper surface 11*a* of tabs 69. Fastener 104 can comprise an adhesive such as glue or double-sided tape, in certain embodiments. Accordingly, rear panel 58*b* can be erected and fastened (e.g., adhered) to tabs 69.

Template 10*b* can also include a rear panel tab 73 extending from rear panel 58*b*, with a crease 75 disposed therebetween. In at least one embodiment, template 10*b* can also include one or more (e.g., opposing) slits 81 extending from (opposite sides of) crease 75 (e.g., extending to the edge of template 10*b*). As depicted in FIG. 3B, rear panel tab 73 can be folded (e.g., rolled), and opposing ends thereof secured together by means of fastener 104*d*, to form paint brush retaining element 114*b*. With handle 111*b* extending through opening 102*b*, and leading edge 126*b* aligned with crease 34*b*, cover panel 30*b* can be folded along crease 34*b* so as to fold over paint brush 106*b*. Cover panel 30*b* also includes front tabs 49 extending therefrom (opposite crease 34*b*), with crease 51 disposed therebetween. Accordingly, opposing corner portions 67 can be folded along respective creases 65, and opposing front tabs 49 can be folded along respective creases 51, such that tabs 49 become inserted behind corner portions 67 or between corner portions 67 and folded tabs 69 and/or corrected rear panel 58*b*, thereby securing cover panel 30*b* over paint brush 106*b* and disposing container 12*b* in a closed packaging configuration (not shown).

Alternatively, as depicted in FIGS. 3C-3D, template 10*b* can be folded so as to dispose container 12*b* in an edging configuration. In particular, as depicted in FIG. 3C, cover panel 30*b* can also be folded along crease 42*b*, and optionally, a long optional crease 43, such that tabs 49 are disposed adjacent to upper surface 11*a* of floor panel 14*b*. Tabs 49 can be folded along creases 51 such that tabs 49 extend towards crease 34*b*, as illustrated in the depicted embodiment. Alternatively, tabs 49 can be folded along creases 51 such that tabs 49 extend away from crease 34*b*.

As further depicted in FIG. 3D, cover panel 30*b* can be further folded against upper surface 11*a* of floor panel 14*b*, thereby forming paint brush raising component 112*b*. In certain embodiments, tabs 49 can be further folded (inward or outward) along crease 51, such that crease 51 becomes aligned with crease 34*b*. Cover panel 30*b* also includes optional crease 43 to allow cover panel 30*b* to form a raising component 112*b* in one or more additional configurations. Optional tabs 45 extending (laterally) from cover panel 30*b* can be inserted into optional slits 47 extending through side wall panels 62*b* (e.g., to help retain raising component 112*b* adjacent to and/or against upper surface 11*a* of floor panel 14*b*. Paint brush 106*b* can be disposed in receiving area 116*b* by inserting a handle 111*b* through opening 102*b*, placing brush and 108*b* a top raising component 112*b*, and aligning leading edge 126*b* of bristles 122*b* with painting edge 120*b* of container 12*b*.

As described previously, raising component 112*b* can space bristles 122*b* and/or leading edge 126*b* thereof away from painting edge 120*b* (e.g., such that a (vertical) gap or spacing 127*b* is disposed therebetween. The spacing effect of raising component 112*b* can be overcome by applying force (or pressure) to paint brush 106*b*, as described previously.

Figure 4A:
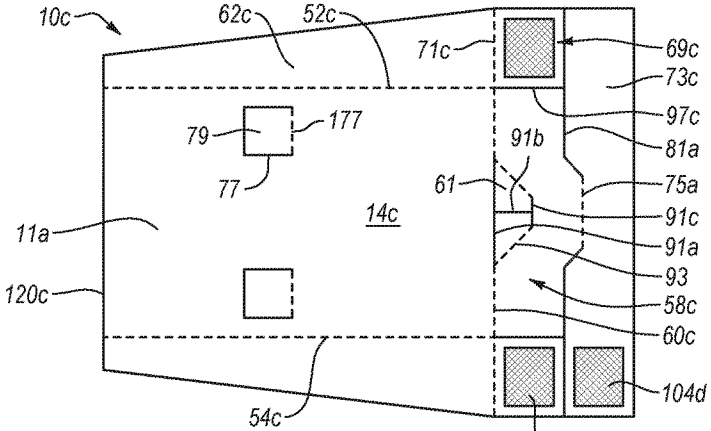
FIG. 4A illustrates a top plan view of a template useful in forming a reconfigurable paint brush container according to another embodiment of the present disclosure.
Figure 4B:
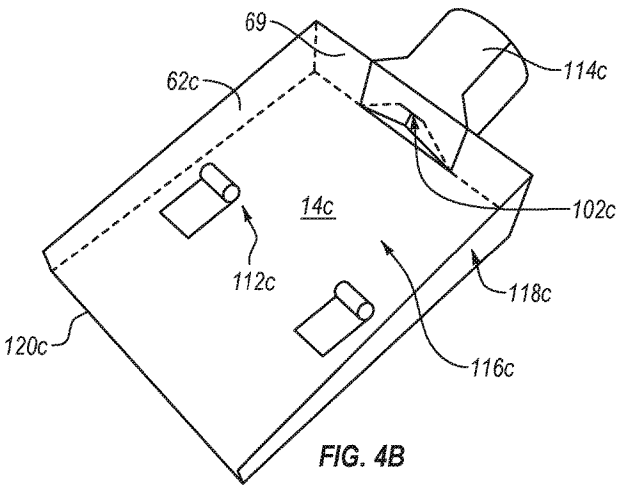
FIG. 4B illustrates a perspective view of a reconfigurable paint brush container formed from the template of FIG. 4A and disposed in an edging configuration.

FIGS. 4A-4B illustrate an alternative embodiment in which template 10*c* does not include a cover panel. Instead, floor panel 14*c* has one or more slits 77 extending therethrough so as to form one or more tabs 79. An optional crease 177 can extend between opposing ends of slit(s) 77, such that tab(s) 79 can be folded (e.g., or rolled) so as to form one or more raising components 112*c*. Like other raising components described herein, raising component 112*c* can be configured to space bristles (or a leading edge thereof) of a paint brush away from painting edge 120*c*, so as to for a gap or space therebetween. Unlike some other embodiments, template 10*c* presents painting edge 120*c* without needing to fold and/or manipulate a cover panel.

Side panels 50*b* and 54*b* of template 10*c* each have a rear tab 69*c* extending from sidewall panel 62*b* adjacent to rear panel 58*c*, with a crease 71*c* disposed between rear tab 69*c* and sidewall panel 62*c*, and a slit 97*c* disposed between rear tab 69*c* and rear panel 58*c*. In at least one embodiment, creases 71*c* can be aligned with crease 60*c* and slits 97*c* can be aligned with creases 52*c* and 54*c*, respectively.

Sidewall 118*c* can be erected and/or formed by folding template 10*c* along creases 52*c* and 54*c* so as to erect sidewall panels 62*c*, folding template 10*c* along crease 60*c* so as to erect rear panel 58*c*, folding tabs 69*c* along creases 71*c*, and securing folded tabs 69*c* to rear panel 58*c* by means of fasteners 104, thereby forming receiving area 116*c*.

Rear panel 58*c* also has an opening 102*c*. However, unlike some other embodiments, opening 102*c* is at least partially covered by one or more tabs 61. For instance, template 10*c* can also include a slit 91*a* extending along a portion of crease 60*c*, a slit 91*b* extending from (a middle portion of) slit 91*a* at least partially through rear panel 58*c*, and/or a slit 91*c* extending across an end of slit 91*b* (opposite slit 91*a*). Slits 91*a*, 91*b*, and 91*c* form tabs 61, as well as opening 102*c*. Opposing creases 93 can allow tabs 61 to yield to a paint brush handle inserted therethrough. In addition, tabs 61 can at least partially retain the paint brush handle with the and opening 102*c*, such that the paint brush handle, and the paint brush bristles attached thereto, are retained in a predetermined position. Accordingly, tabs 61 can comprise a retaining element.

Template 10*c* can also include a rear panel tab 73*c* extending from rear panel 58*c*, with a crease 75*a* disposed therebetween. In at least one embodiment, template 10*c* can also include one or more (e.g., opposing) slits 81*a* extending from (opposite sides of) crease 75*a* (e.g., extending (past tabs 69*c*) to the edge of template 10*b*). As depicted in FIG. 4B, rear panel tab 73*c* can be folded (e.g., rolled), and opposing ends thereof secured together by means of fastener 104*d*, to form paint brush retaining element 114*b*.

FIG. 5A illustrates another embodiment of a template 10*d* useful in forming container 12*d* depicted in FIGS. 5B-5D. Template 10*d* and container 12*d* include many of the features found in other embodiments of the present disclosure, including panels, slits, creases, tabs, and so forth. For instance, a floor panel 14*d* has a cover panel 30*d* extending from a front end 16*d* with a crease 34*d* disposed therebetween, opposing side panels 50*d* and 54*d* extending laterally from opposing sides 20*d* and 22*d* with respective creases 52*d* and 56*d* disposed therebetween, and a rear panel 58*d* extending from a rear end 18*d* with a crease 60*d* disposed therebetween.

Cover panel 30*d* comprises a first portion 46*d* extending from front end 16*d* and/or crease 34*d*, a second portion 41*d* extending from first portion 46*d* with a crease 43*d* disposed therebetween, and a third portion 48*d* extending from second portion 41*d* with a crease 42*d* disposed therebetween, cover panel 30*d* and/or third portion 48*d* thereof having an outer edge 36*d*, opposite floor panel 14*d*.

Side panels 50*d* and 54*d* each include a side wall panel portion 62*d* extending from respective sides 20*d* and 22*d* of floor panel 14*d* with respective creases 52*d* and 56*d* disposed therebetween and a cover portion 64*d* extending from sidewall panel portions 62*d* with a crease 66*d* disposed therebetween. Side wall panel portions 62*d* can have a slanted front edge 84*d* extending away from cover panel 30*d*

(at approximately 45°). Cover portion 64*d* comprises a lower portion 82*d* extending from front edge 84*d*, an upper portion 80*d* opposite lower portion 82*d*, and a middle portion 89 are disposed therebetween. A slit 105 extends between lower portion 82*d* and middle portion 89 and a slit 107 extends between middle portion 89 an upper portion 80*d*. An inner portion 121 of slit 105 extends partially into a sidewall panel portion 62*d* (optionally at an angle of about 45°) and an inner portion 123 of slit 107 extends partially into side wall panel portion 62*d*. A crease 125 extends between endpoints of inner portion 121 and inner portion 123. A middle part 109 of slit 107 extends into upper portion 80*d*, forming a tab 113. A crease 115 is disposed between middle portion 89 and tab 113. Upper portion 80*d* and a lower portion 82*d* each also include an outer crease 117, and an outer side wall tab 119 extending therefrom.

Tab 69*d* extend from rear end 88*d* of side wall panel portions 62*d*, with a crease 71*d* disposed therebetween. A rear cover tab 95 extends from tab 69*d*, with a crease 131 disposed therebetween. A slit 129 extends between upper portion 88*d* and rear cover tab 95.

Template 10*d* can also include a slit 91*d* extending along the middle portion of crease 60*d* and a slit 91*e* extending from slit 91*d* partially into rear panel 58*d*. A crease 93*d* extends between endpoints of slit 91*d* and 91*e*, forming tabs 61*d*. A rear panel tab 73*d* extends from rear panel 58*d*, with a crease 75*d* disposed therebetween, and opposing slits 81*d* extending from crease 75*d* and between rear panel tab 73*d* and rear panel 58*d*, tabs 69*d*, and rear cover tab 95.

As depicted in FIG. 5B, and with continued reference to FIG. 5A, template 10*d* can be folded into a packaging container 12*d* (in a packaging configuration) by folding template 10*d* along crease 60*d*, thereby erecting rear panel 58*d*, along crease 75*d*, thereby folding rear panel tab 73*d* away from floor panel 14*d*, along creases 52*d* and 56*d*, thereby erecting side panels 50*d* and 54*d*, along crease 71*d*, thereby folding rear tabs 69*d* against erected rear panel 58*d*, along crease 131, thereby folding rear cover tabs 95 over floor panel 14*d*, along crease 66*d*, thereby folding cover portion 64*d* of side panels 50*d* and 54*d* over floor panel 14*d*, and along creases 117, thereby folding the outer tabs 119 against erected side wall panel portion 62*d*. One or more of the foregoing folding steps can form sidewall 118*d*. It is noted that the foregoing folding steps can be conducted in various orders and/or sequences. Indeed, a variety of aspects and/or outer displays can be achieved by altering the order and/or sequence of the foregoing folding steps.

As described above, rear panel 58*d* can be secured to tabs 69*d* by means of one or more fasteners 104 disposed on upper surface 11*a* (or lower surface 11*b*) of rear panel 58 and/or tab(s) 69*d*). Similarly, fasteners 104 can also be disposed on upper surface 11*a* (or lower surface 11*b*) outer tabs 119 and/or sidewall panel portions 62*d* adjacent thereto. Accordingly, outer tabs 119 can be secured to side wall panel portions 62*d*. In addition, rear panel tab 73*d* can be folded (e.g., rolled) so as to form paint brush retaining element 114*d*, extending from opening 102*d* of rear panel 58*d*. A paint brush can then be disposed within packaging container 12*d* by inserting a handle portion thereof through opening 102*d* and retaining element 114*d*, such that a brush portion is disposed on floor panel 14*d*, within side wall 118*d*, and beneath cover portion 64*d*. Cover panel 30*d* can then be folded at creases 34*d* and 43*d*, such that cover panel 30*d* is disposed on top of container 12*d*. In the depicted embodiment, outer edge 36*d* of cover panel 30*d* can be inserted beneath upper portion 80*d*, such that at least part of the third portion 48*d* is disposed on top of tab 13 and at least a part of third portion 48*d* is disposed beneath upper portion 80*d*, thereby securing cover panel 30*d*.

In an alternative, edging configuration, illustrated in FIG. 5C-5D, tabs 113 can be folded along crease 115 such that they become disposed beneath and/or against middle portion 89 (via middle part 109 of slit 107), side wall panel portions 62*d* can be folded along creases 125, and middle portion 89 of cover portion 64*d* can be folded along crease 66*d*, such that middle portion 89 of cover portion 64*d* is depressed to (or towards) floor panel 14*d*. It will be appreciated that middle portion 89 is thereby separated from upper portion 80*d* (via slit 107) and from lower portion 82*d* (via slit 105).

Cover panel 30*d* can then be wrapped around depressed middle portion 89 (and folded tabs 113) by inserting outer edge 36*d* beneath lower portion 82*d* of cover portion 64*d* and over the top (or outer surface 11*b*) of middle portion 89, and folding cover panel 30*d* along crease 42*d* such that third portion 48*d* of cover panel 30*d* folds beneath middle portion 89 (e.g., with tabs 113 disposed between the third portion 48*d* and middle portion 89), thereby forming raising component 112*d* (comprising middle portion 89, tabs 113, and cover panel 30*d*), receiving area 116*d* (above the floor panel 14*d*, beneath upper portion 80*d* and lower portion 82*d* of cover portion 64*d*, atop raising component 112*d*, and/or within side wall 118*d*), and painting edge 120*d* (at folded crease 34*d* and/or the junction between folded cover panel 30*d* floor panel 14*d*). Moreover, raising component 112*d* can provide or form a fulcrum 130*d*, on which paint brush 106*d* (see FIG. 5D) can rest. Fulcrum 130*d* can comprise an edge formed at folded crease 42*d* and/or a part of second portion 41*d* adjacent crease 42*d*, in some embodiments.

As depicted in FIG. 5D, paint brush 106*d* can be disposed (or placed) in container 12*d* (in the illustrated edging configuration) by inserting paint brush 106*d* (or handle 111*d* of handle portion 110*d* thereof) beneath lower portion 82*d* of cover portions 64*d* at painting edge 120*d*, over raising component 112*d* (or fulcrum 130*d* thereof), beneath upper portion 80*d* of cover portions 64*d*, through opening 102*d* inner rear panel 58*d*, and/or through retaining element 114*d*, such that middle portion 124*d* of paint brush 106*d* rests on raising component 112*d* (or fulcrum 130*d* thereof) and leading edge 126*d* of bristles 122*d* become aligned with painting edge 120*d* of container 12*d*. Raising component 112*d* (or fulcrum 130*d* thereof) can also be structurally configured (or adapted) to space bristles 122*d* (or leading edge 126*d* thereof) away from painting edge 120*d*.

An illustrative method of edging a painting surface (e.g., wall) 155 at a transition (e.g., corner) 150 can include forming container 12*d* in an edging configuration, as described above, inserting paint brush 106*d* into container 12*d* or receiving element 116*d* thereof, as described above, with a portion of paint brush 106*d* (e.g., middle portion 124*d*) disposed (or resting) on raising component 112*d* (or fulcrum 130*d* thereof), applying paint 132 to bristles 122*d* or leading edge 126*d* thereof, as described previously, aligning leading edge 126*d* of bristles 122*d* with painting edge 120*d* of container 12*d*, aligning painting edge 120*d* of container 12*d* with transition 150 of painting surface 155, with bristles 122*d* (or leading edge 126*d* thereof) adjacent a painting surface portion 152 and container 12*d* adjacent a non-painting surface portion 154, and applying a force on paint brush 106*d* in the direction of raising component 112*d*, the force overcoming the spacing of raising component 112*d* and bringing bristles 122*d* (or leading edge 126*d* thereof) into contact with painting edge 120*d*, such that paint 132 is applied to painting portion 152 of painting surface 155, container 12*d* optionally substantially inhibiting (e.g., obstructing, impeding, preventing, etc.) paint 132 from being applied to non-painting portion 154 of painting surface 155. In at least one embodiment, the method can also include grasping paint brush 106*d* (or handle 111*d* thereof), optionally about retaining element 114*d* and/or upper portion 80*d* of cover portion 64*d*.

It will be appreciated that other embodiments disclosed and described herein can be similarly implemented in analogous painting methods.

Figure 6:
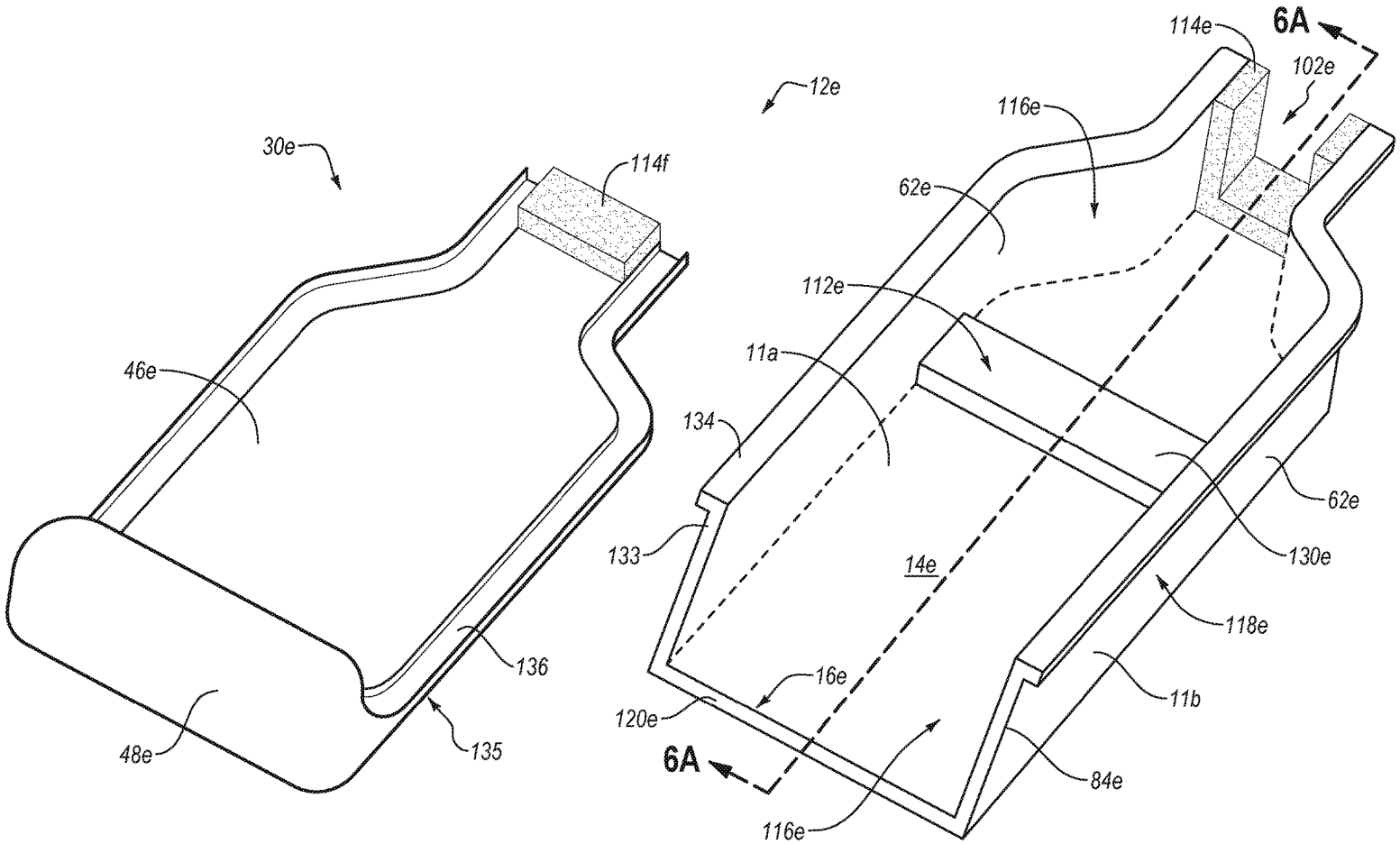
FIG. 6 illustrates a perspective view of a reconfigurable paint brush container in an edging configuration according to another embodiment of the present disclosure.

FIG. 6 illustrates another embodiment of a container 12*e* in an edging configuration, in which container 12*e* comprises a receiving element 116*e*, and a detachable cover (or lid) 30*e*. Unlike other embodiments, where the container is formed of a folded template, container 12*e* is formed of a material that are generally retains (or returns to) its shape in the depicted configuration. For instance, container 12*e* can be formed of a semi-rigid plastic material, that has a degree of flexibility, but which cannot be unfolded into a flat configuration without breaking. It is noted, however, that other containers described herein can also be formed of more rigid materials, similar to container 12*e*, and vice versa.

Receiving element 116*e* comprises a floor panel 14*e* and a sidewall 118*e* extending from the perimeter edge thereof. Side wall 118*e* does not, however, extend across (at least a portion of) front edge 16*e* of floor panel 14*e*. Moreover, with cover 30*e* being detachable, front edge 16*e* forms painting edge 120*e*. In addition, cover 30*e* does not fold to form a raising component 112*e*. Instead, raising component 112*e* extends (vertically upward) from upper surface 11*a* of floor panel 14*e*. As depicted in in FIG. 6, raising component 112*e* extends between opposing side wall panels 62*e* of sidewall 118*e*. It will be appreciated, however, that raising component 112*e* need not extend entirely between opposing sides of side wall 118*e*. Raising component 112*e* can be formed of the same or different material as floor panel 14*e* and/or sidewall 118*e*. Similar to other embodiments described herein, raising component 112*e* (or fulcrum 130*e* thereof) can be configured to receive at least a portion of a paint brush thereon and space the bristles (or leading edge) thereof away from painting edge 120*e*.

Receiving element 116*e* has an outer edge 133 extending about the upper edge of side wall 118*e*, down slanted front edge 84*e* of side wall panels 62*e*, and/or across front edge 16*e* (or painting edge 120*e*). In the depicted embodiment, outer edge 133 includes a sealing element 134. Sealing element 134 can comprises a hook or other formation extending about outer edge 133, whereby container 12*e* can be substantially sealed (e.g., at least partially airtight) and/or covered. For instance, cover 30*e* has an outer edge 135 having a shape corresponding to the shape of outer edge 133 of receiving element 116*e*. Outer edge 135 of cover 30*e* also comprises a sealing element 136 corresponding to and/or compatible with sealing element 134 of receiving element 116*e*. In particular, first portion 46*e* of cover 30*e* can extend over and/or being secured to sidewall panels 62*e* and second portion 48*e* of cover 30*e* can extend down front edge 84*e* and across front edge 16*e* (or painting edge 120*e*).

Receiving element 116*e* can also include a retaining component 114*e* disposed at the rear end of receiving element 116*e*, adjacent opening 102*e* and/or opposite painting edge 120*e*. In at least one embodiment, retaining component 114*e* can comprise a sealing material, such as foam, sponge, rubber, or other suitable material. Retaining component 114*e* can extend across the rear ends of side wall panels 62*e* and floor panel 14*e*. Cover 30*e* can also have a retaining component 114*f* extending across a rear portion thereof, opposite second portion 48*e*. When cover 30*e* is attached to receiving element 116*e*, sealing element 134 can mate with sealing element 136 to create a seal between outer edges 133 and 135, disposing container 12*e* in a packaging configuration. Retaining components of 114*e* and 114*f* can form a (partial) seal between container 12*e* and a paint brush handle extending through opening 102*e*. Accordingly, a paint brush having paint disposed on the bristles thereof, can be placed in receiving element 116*e* and, with cover 30*e* attached to receiving element 116*e*, can be (at least temporarily) protected and/or preserved within container 12*e*.

Figure 6A:
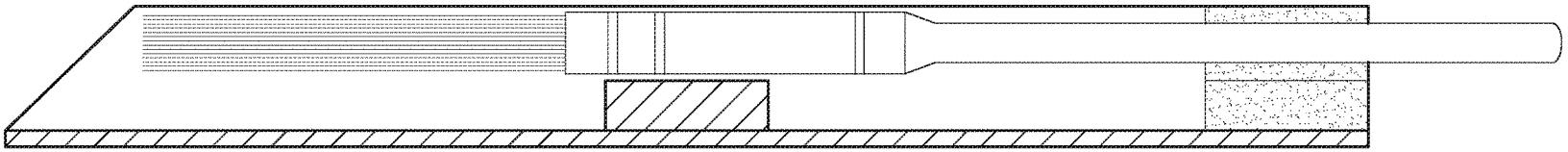
FIG. 6A illustrates a cross-section view of the portion of the reconfigurable paint brush container of FIG. 6 that is usable as an edging tool.

FIG. 6A illustrates a cross-sectional view of receiving element 116*e* with a paintbrush disposed at least partially therein. As can be seen, raising component 112*e* is positioned so at to initially space the bristles of the paint brush away from floor panel 14*e* and/or painting edge 120*e*. As discussed with the other embodiments disclosed herein, the paintbrush can be advanced so that the ends of the bristles are aligned with the painting edge 120*e* and the paint brush can be rotated about the raising component 112*e* so as to bring the paint brush bristles into contact with the painting edge 120*e*.

Various embodiments disclosed and described herein include one or more slits and/or creases. As used herein, slits (are adapted to) extend (entirely) through a portion of a template (e.g., from an upper surface 11*a* to a lower surface 11*b* thereof), such that two adjacent portions of the template are (or can be) separated one from another. In certain embodiments, for instance, slits can include perforated portions, wherein the perforations extend (entirely or partially) through the template with intervening template portions disposed therebetween. Such intervening template portions can be broken (such as by tearing, cutting, applying pressure to the point of rupture, etc.) to separate the two adjacent portions of the template. In other embodiments, the template may include a slit line or other indication of where the template is to be cut, torn, or ruptured so as to separate the two adjacent portions of the template. All such features are contemplated herein as slits.

Similarly, creases (are adapted to) form a fold line in the template, along which the template can be pre-designed to be folded so as to form a packaging and/or edging container. Such creases can comprise one or more depressions, compressions, perforations, thinning portions, or any other suitable form of creasing, as known in the art. In certain embodiments, however, such fold lines can be indicated on one or more surfaces of the template without necessarily being pre-folded.

In addition, certain embodiments can include a handle adaptor for sizing the container (12), opening (102), and/or retaining element (114) to fit a specific configuration (e.g., size, shape, etc.) of paint brush handles. Such adaptors can be received by container (12), opening (102), and/or retaining element (114) and can provide a smaller opening through which the handle may pass and/or within which the paint brush may be retained.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure. Moreover, unless a feature is described as requiring another feature in combination therewith, any feature herein may be combined with any other feature of a same or different embodiment disclosed herein. Furthermore, various well-known aspects of illustrative systems, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain embodiments and details have been included herein and in the attached disclosure for purposes of illustrating embodiments of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

What is claimed is:

1. A reconfigurable paint brush container and edging tool, comprising:

a paint brush receiving element having a brush end and an opposing handle end, the receiving element being sized and shaped to receive a hand-held paint brush therein with bristles of the paint brush disposed at the brush end and a handle of the paint brush disposed at the handle end, the paint brush receiving element comprising:

a floor panel having a painting edge disposed at the brush end, the painting edge having a substantially linear configuration;

opposing side wall panels extending upwardly from the floor panel; and a cover portion extending between the opposing side wall panels and disposed above the floor panel, a middle portion of the cover portion and portions of the opposing side wall panels being selectively foldable between a container configuration and a painting configuration, wherein:

in the container configuration, the middle portion of the cover and the floor panel are configured to have a paint brush disposed therebetween; and in the painting configuration, the middle portion of the cover portion is folded towards the floor panel such that the middle portion is positioned between the floor panel and a paint brush received within the container, the folded middle portion being spaced apart from the floor panel such that the folded middle portion forms a paint brush raising component that functions as a fulcrum to selectively space bristles of a paint brush away from the painting edge.

2. The container of claim 1, wherein the raising component is reversibly depressible, such that the raising component can be selectively unfolded from the painting configuration in a direction away from the floor panel.

3. The container of claim 1, wherein the container further comprises a covering extending over at least a portion of the floor panel and the painting edge, wherein removal of the covering exposes the painting edge.

4. The container of claim 1, wherein the cover portion comprises a lower portion disposed above a portion of the floor panel adjacent to the painting edge and an upper portion disposed above the floor panel adjacent to the handle end, the middle portion being disposed above the floor panel between the upper portion and the lower portion.

5. The container of claim 4, wherein a slot is formed between the lower portion and the middle portion and a slot is formed between the middle portion and the upper portion.

6. The container of claim 5, wherein the middle portion comprising a tab that extends towards the handle end, the tab being configured to be folded underneath the rest of the middle portion such that the tab is disposed between the rest of the middle portion and the floor panel.

7. A paint edging kit, comprising:

a paint brush having bristles, a handle connected to the bristles, and a middle portion disposed between the handle and the bristles, the bristles having a leading edge opposite the middle portion; and a paint brush container and edging tool, the paint brush being disposable in the container and edging tool, the container and edging tool comprising:

a paint brush receiving element having a brush end, an opposing handle end, a floor extending between the brush end and the handle end, the floor having an upper surface portion and a lower surface portion opposite the upper surface portion, the paint brush being disposed on the upper surface portion, the bristles of the paint brush being disposed adjacent the brush end, and the handle of the paint brush being disposed adjacent the handle end;

a painting edge disposed at the brush end, the painting edge being substantially linear, the floor terminating at the painting edge;

opposing side wall panels extending upwardly from the floor; and a cover portion extending between the opposing side wall panels and disposed above the floor, the cover portion having a lower portion, a middle portion, and an upper portion, the middle portion of the cover portion and portions of the opposing side wall panels being selectively foldable to form a paint brush raising component that is spaced apart from and extend above the floor such that the raising component selectively spaces the leading edge of the bristles away from the painting edge of the container.

8. The kit of claim 7, wherein the container further comprises a paint brush retaining element connected to the receiving element and being adapted to stabilize the paint brush against the raising component, a portion of the paint brush extending through the retaining element.

* * * * *